US008413281B2

(12) United States Patent
Mikuski et al.

(10) Patent No.: US 8,413,281 B2
(45) Date of Patent: Apr. 9, 2013

(54) HAND HELD CLEANING DEVICE FOR AUTOMATED POOL CLEANER

(75) Inventors: Shawn Robert Mikuski, Brick, NJ (US); Stephen Lorne Shulman, Boca Raton, FL (US); Jayson Eduard Vajda, Rivas (NI)

(73) Assignee: Smartpool LLC, Lakewood, NJ (US)

( * ) Notice: Subject to any disclaimer, the term of this patent is extended or adjusted under 35 U.S.C. 154(b) by 214 days.

(21) Appl. No.: 12/857,379

(22) Filed: Aug. 16, 2010

(65) Prior Publication Data

US 2012/0036669 A1 Feb. 16, 2012

(51) Int. Cl.
*E04H 4/16* (2006.01)

(52) U.S. Cl. ..... 15/1.7

(58) Field of Classification Search ..... 15/1.7, 15/328, 329, 331–337, 419
See application file for complete search history.

(56) References Cited

U.S. PATENT DOCUMENTS 5,842,243 A * 12/1998 Horvath et al. ..... 15/1.7
7,694,383 B2 * 4/2010 Zahuranec et al. ..... 15/329

* cited by examiner

*Primary Examiner* — Rachel Steitz
*Assistant Examiner* — Brianne Kalach
(74) *Attorney, Agent, or Firm* — Birch, Stewart, Kolasch & Birch, LLP

(57) ABSTRACT

Disclosed herein is a hand held cleaning unit for use with an automated pool cleaning unit. The pool cleaning unit includes a housing, a pump mechanism for creating a vacuum pressure, intake vents in communication with the pump. The pool cleaning unit includes the housing having an external port and the pump in fluid communication with the external port. The hand held cleaning unit includes a body. The body has a port and the conduit connects the body port with the housing external port. The intake vents opening and closing in response to activation of the hand held cleaning unit. As desired, the hand held unit is activated closing the intake vents and directing the vacuum pressure through the hand held unit instead of the automated cleaning unit. The hand held unit in fluid communication with the pump mechanism.

20 Claims, 7 Drawing Sheets

HAND HELD CLEANING DEVICE FOR AUTOMATED POOL CLEANER

BACKGROUND OF THE INVENTION

Field of the Invention

Automated pool cleaning device or vehicles, commonly referred to as ACV's, are well known in the market. There are three general categories of such cleaners:

1. Robotic Cleaners
2. Pressure Cleaners; and
3. Suction Cleaners.

Each of these devices has its advantages and its disadvantages. For general pool cleaning on regular pool surfaces, each of these cleaners may work in a satisfactory manner. However, this is not necessarily so on irregular surfaces or forms. Under those specialized conditions, it is necessary to manually clean that portion of the pool. Of course, this takes greater effort, but the benefits from cleaning such areas are well worth it for the pool owner with benefits immediately realized. The pool looks bright and clear and inviting to swim in, when the water is in this condition.

It is well known to use manual scrubbing tools such as brushes and even brushes on swivels and brushes held by long handles. In fact, currently professional pool cleaners use such tools to ensure that there is no unsightly dirt caused by irregular forms or surfaces. However, upon scrubbing such areas, the dirt and debris merely float in the water or are left for the ACV to pick up. There is, of course, the great possibility that such dirt and debris will remain in the water until attaching themselves, once again to an irregular surface or form.

In addition to pools, cleaning devices are needed for water features such as fountains and water vessels of all kinds. Anywhere water is found, dirt and debris will likewise attach themselves to the vessel's surface and cause an unsightly condition. In order to maintain sparkling and beautiful conditions of such water vessels they will likewise need to be cleaned. A failure to clean will defeat the purpose of pool or water feature or in fact, any other water vessel. It can also be a source for disease and illness. Cleaning is not merely an option, but a necessity when owning such a water vessel. It is a responsibility implicit with the condition of ownership.

As will be appreciate by even those with the most causal familiarity with pools and water features, they are found in a wide variety of shapes and configurations, many of which define irregular geometric forms. In fact, some of the most beautiful water features and pools have the most irregular shapes and forms. Such irregular shapes and forms are the most difficult to clean. Certainly, common automatic pool cleaners need manual assistance to perform a thorough job of cleaning of such vessels.

With particular attention to pools, cleaning issues include steps, sun shelves, and all convex corners. Thus, there is a need for a cleaning device which can readily be adapted to clean irregular surfaces and forms, not only for pools, but also for water vessels of all kind. This cleaning device should be an improvement over manual methods where the scrubbing merely leaves the dirt and debris floating in the vessel's water. The improved cleaning device should preferably adapt to the ACV such that the pool surface is cleaned and the dirt and is removed from the pool water Additionally, it would be advantageous if such a new pool cleaning device were adaptable to already existing equipment in order to avoid the duplication of machinery. Duplicating machinery cause negative economic consequences. Additionally, other considerations, such as storage space are negatively affected by duplicating machinery. For example, should another entirely new cleaning device be required, instead of one which readily adapts to the existing ACV, that new cleaning device would need its own storage space and maintenance and repair. On the other hand, if such a new device were readily adaptable to the existing ACV, it would merely be an accessory and not require separate maintenance or repair that was more than a new brush or other manual tool. Additionally, the required storage space would be drastically reduced.

For example, without passing judgment on the relative merits of U.S. Pat. No. 7,060,182, it is clear that this proposal is for an entirely separate hand held device, which is designed to aid the pool owner in cleaning such irregular surfaces. The '182 device requires its own vacuum system, including its own pump and conduit network, its own operating mechanism, seals, knobs, switches and its own filtering system. The '182 proposed device is clearly a separate piece of pool equipment, which will need its own maintenance and repair and it's own space for storage. In fact, it is submitted that the '182 device offers no attempt whatsoever to work cooperatively with existing pool equipment. By adding the '182 device to the owner's tools, one adds all the responsibilities of adding an entirely new piece of equipment.

As can be readily appreciated, it would be advantageous to have a manual cleaning device for cleaning irregular surfaces, shapes and forms, which removed the dirt and debris from the pool water and which cooperated with existing pool equipment. This would provide economical as well as other benefits for the pool owner, water feature owner and any other owner of a similar water vessel.

SUMMARY OF THE INVENTION

It is an object of this invention to provide a hand held cleaning unit, which readily connects with existing pool equipment and deans irregular surfaces and hard to clean shapes and forms.

It is an additional object of this invention to provide such a hand held cleaning unit, which requires little, or no separate maintenance and which is easy to store and use.

It is an additional object of this invention to provide such a cleaning unit with a comfortable handle and brush head for cleaning hard to reach areas.

It is an additional object of this invention to provide such a cleaning unit with a the ability to over-ride the automated cleaning unit's default programming and allow a sub-program to run which is compatible with the hand held cleaning unit's function and which is specifically designed to facilitate the use of the hand held cleaning unit.

In accordance with the above objects and those that will be mentioned and will become apparent below, the hand held cleaning unit in accordance with this invention comprises:

conduit means from the hand held unit to the automated cleaning unit or vehicle (ACV) for facilitating fluid communication with a pump mechanism, the pump mechanism creating a vacuum within the hand held unit through the conduit means, providing suction through which dirt and debris are transmitted to the ACV through the conduit;

the ACV having intake vents and the hand held cleaning unit (HHU) including means for closing the vent intakes upon activation as well as redirecting the vacuum pressure to the conduit to the hand held cleaning unit; and means for de-activating the HHU and returning the intake vents and vacuum to their normal positions.

The HHU requires little if any modification of the ACV in order to function. For example, it is not uncommon for the ACV to have an external port already in the housing performing the function as stated above. Additionally, modifying the default programming to switch manual programming allows the substitution of the ACV default programming to the HHU programming. This can be accomplished in a variety of ways, including electronically, electro-mechanically and mechanically. Additionally, infrared switches can also be used to accomplish this function.

In general, the instant invention, a hand held cleaning unit, which is adaptable for attachment to an existing automated cleaning unit. Once attached, the HHU disables the default programming of the ACV and sends the programming into a manual mode. Once in the manual mode, a sub-program is then activated which causes the vehicle to cease all locomotion while continuing operation of the pump and consequently the vacuum pressure within the ACV. Additionally, at various points, the ACV has suction points through which dirt and debris enter the HHU and are directed to a filter media within the HHU housing. Upon re-direction of the vacuum pressure from the ACV suction points to the conduit leading to the HHU, the debris and dirt is still directed toward the filter media for cleaning. This operation continues until de-activation of the HHU.

Upon ceasing locomotion, the HHU is used to manually clean the pool or water vessel surfaces. The HHU, in an exemplary embodiment, is fitted with a rigid handle. This facilitates cleaning in faraway and in hard to reach places. In another preferred embodiment, the HHU includes a main body having a distal end. The distal end is fitted with a specialized end that allows specific cleaning of hard to reach and difficult to clean places.

It is an advantage of this invention to provide a new, novel and inventive pool cleaning device which is compatible with existing pool equipment and capable of cleaning hard to reach and irregular surfaces and forms.

It is also an advantage of the hand held cleaning unit in accordance with this invention to be readily adaptable to clean a wide variety of surfaces and forms for thorough cleaning of all water vessel surfaces.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
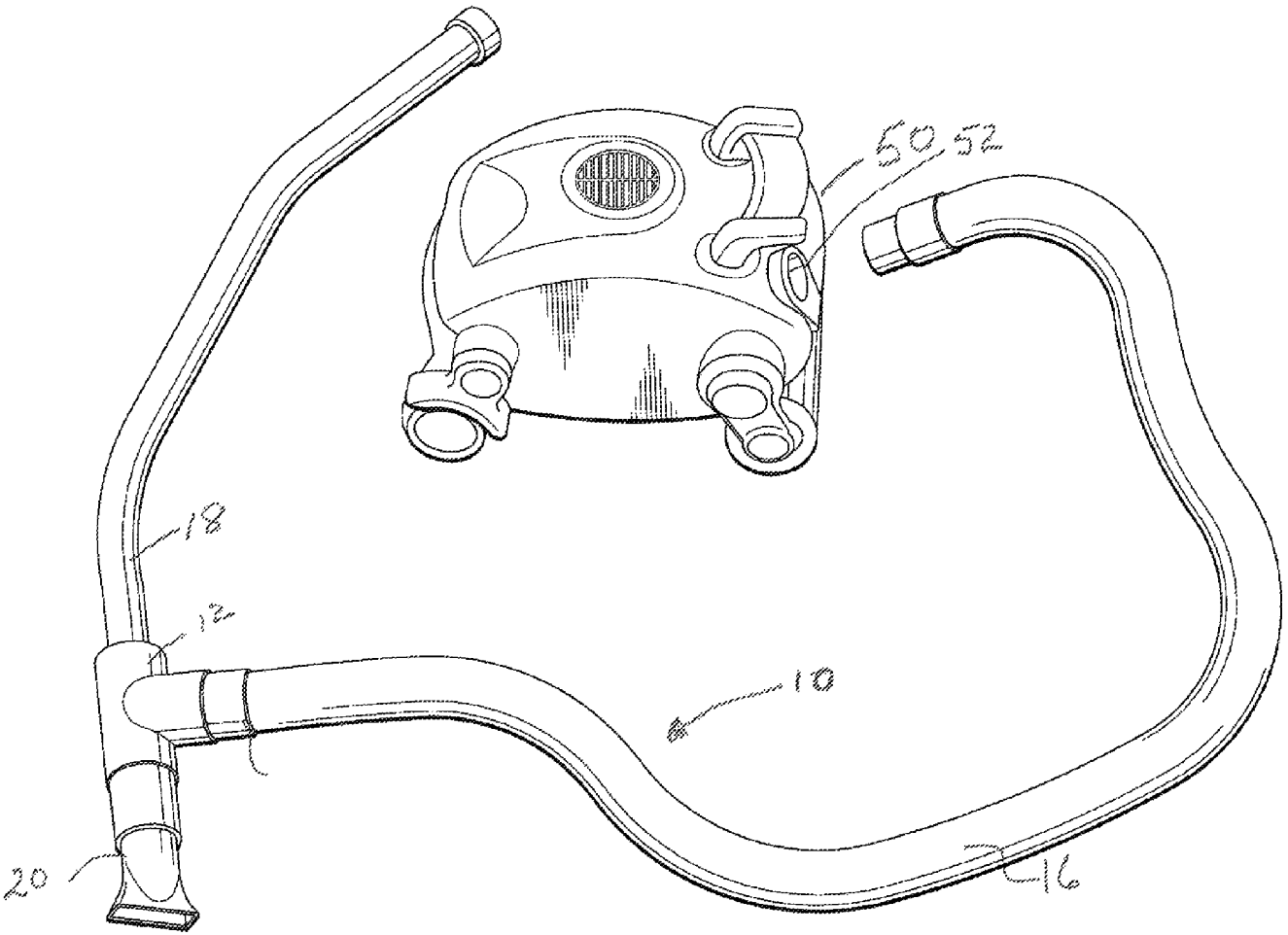
FIG. 1 is a perspective view of the hand held cleaning unit with the automated cleaning vehicle.

The invention will now be described with respect to FIGS. 1-9, which illustrate the construction and use of the preferred embodiments of the hand held cleaning unit in accordance with the invention. With particular reference to FIGS. 1-4, there is shown the hand held cleaning unit, generally shown by the numeral 10.

The hand held cleaning unit (HHU) 10 includes a main body 12. The main body has a first port 14 adapted for connection with the conduit 16. The conduit 16 connects at the first port 14 and provides fluid communication between the HHU 10 and the automated cleaning vehicle (ACV) 50.

The HHU 10 has a first end adapted to receive a handle 18 and a second end adapted for receiving a specialized cleaning tool. The second end 20 is shown in the form of a suction end. However, as will be appreciated by those skilled in the field, any sort of second end cleaning tool is attachable. For example, a scrubber end or specialized tool for cleaning curved surfaces or irregular forms is well known in the field and is readily attachable to the second end 20. Additionally, the second end 20 in an exemplary embodiment includes a swivel head with brushes for difficult to reach places and irregular forms.

The handle 18 in various exemplary embodiments is of the length desired. For example, in some instances, it may be desirable for the handle 18 to be 10 feet. In other instances, a 15' or 20' handle may be preferred. To accommodate the user's specific needs, various handle lengths are adaptable for connection with the first end of the HHU main 12.

In a specific preferred embodiment, the handle 18 and first end are compatible with a mating force or pressure fit as is well known in the art. In other exemplary embodiments, a snap lock is used. Regardless of the specific connection model used, the handle 18 is interchangeable and various length handles can thus be adapted for use with the HHU 10.

Figure 2:
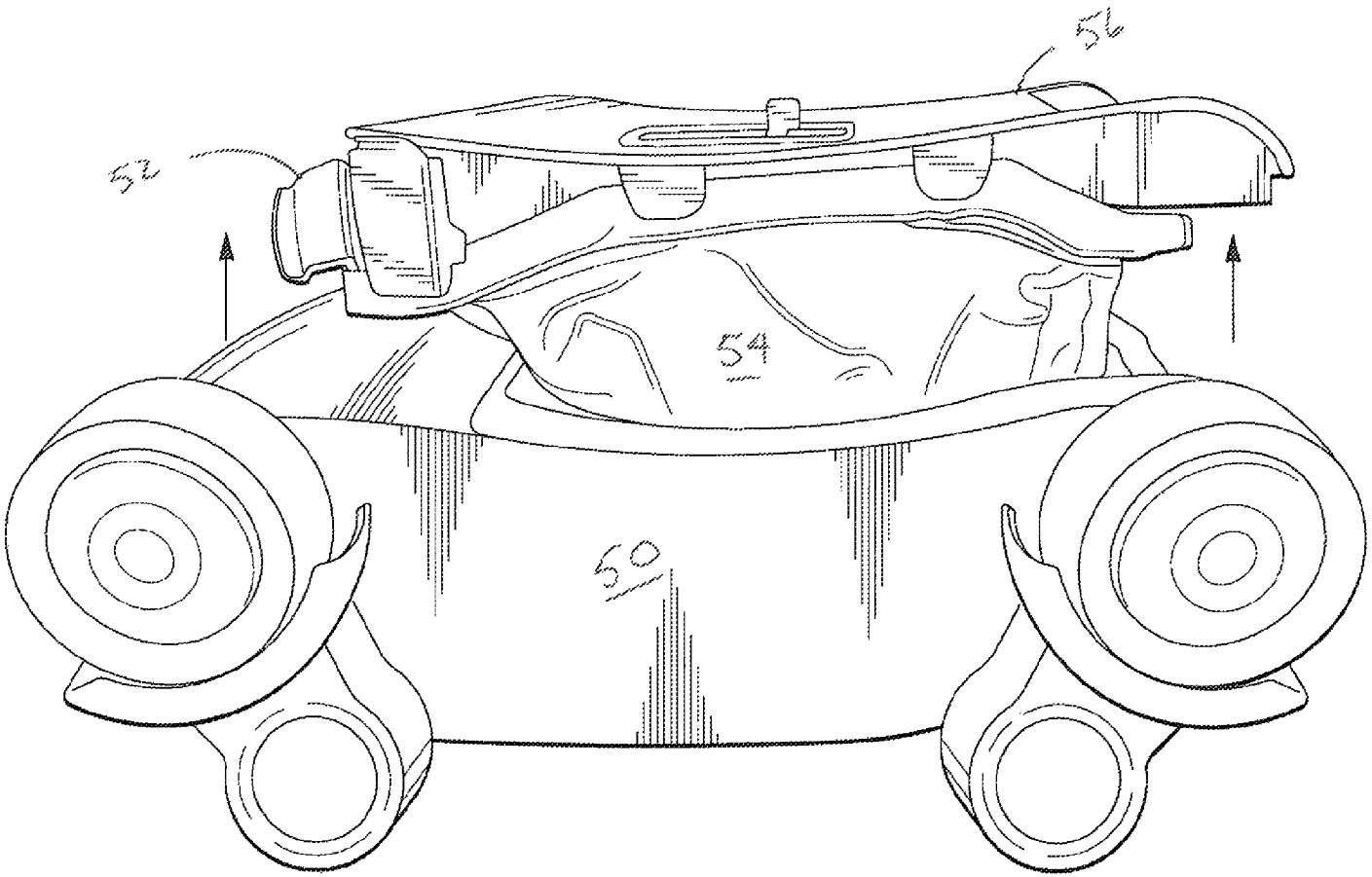
FIG. 2 is a perspective view of the automated cleaning vehicle having an external port.
Figure 3:
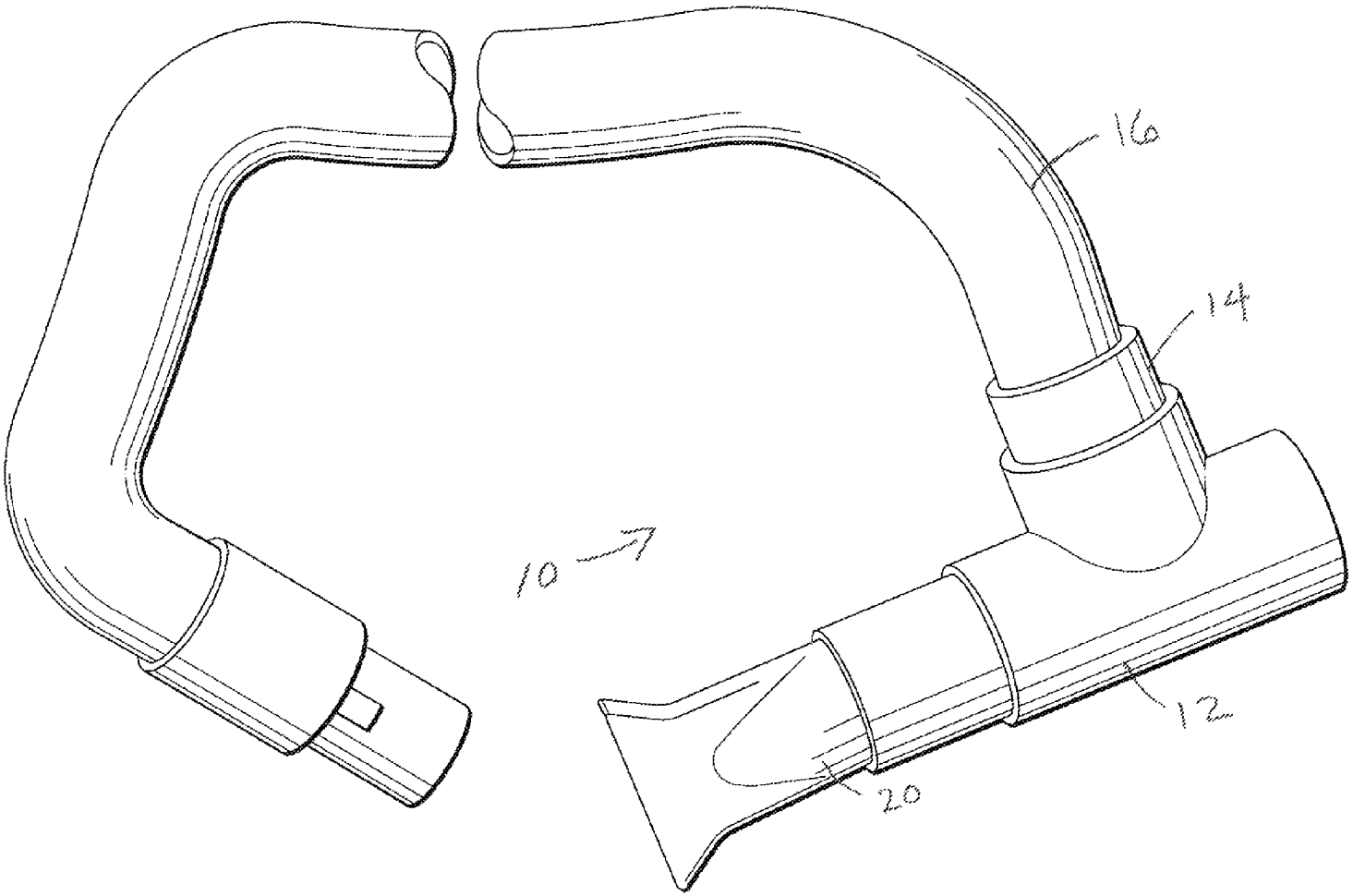
FIG. 3 is a perspective view of the hand held cleaning unit in accordance with the present invention.
Figure 4:
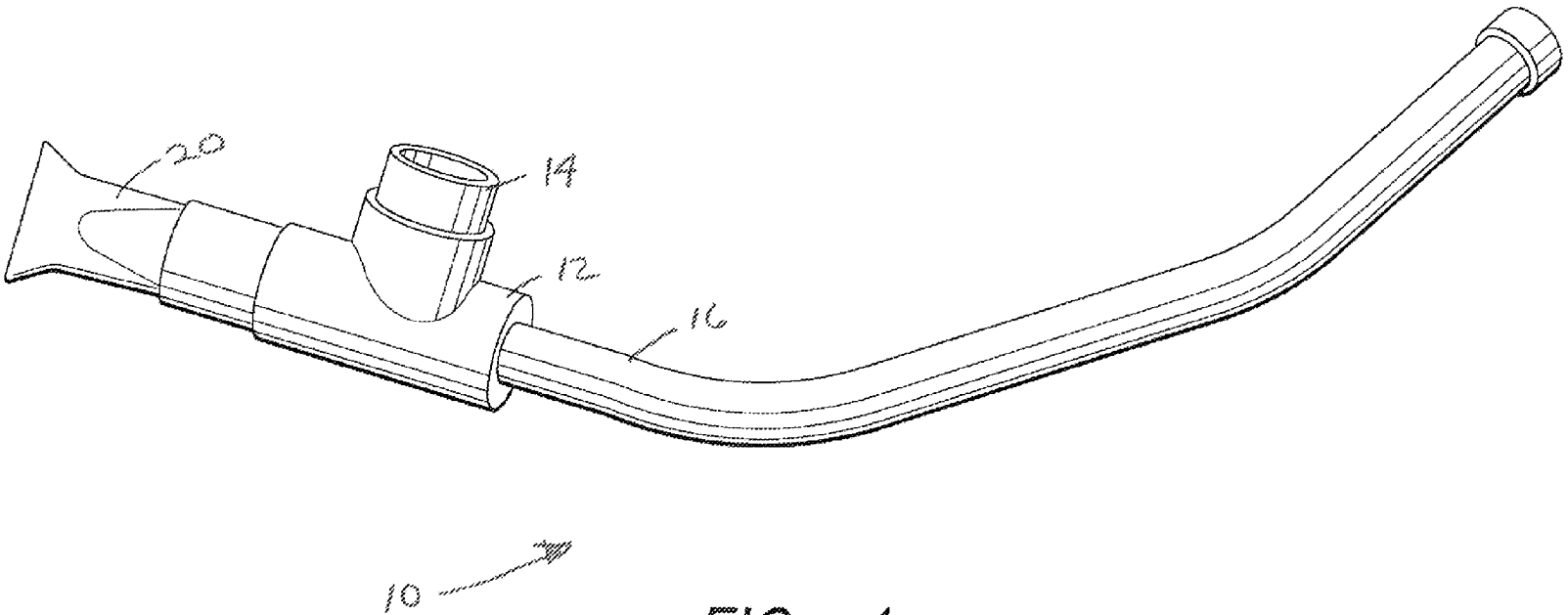
FIG. 4 is a perspective view of an alternative hand held cleaning unit in accordance with the present invention.
Figure 6:
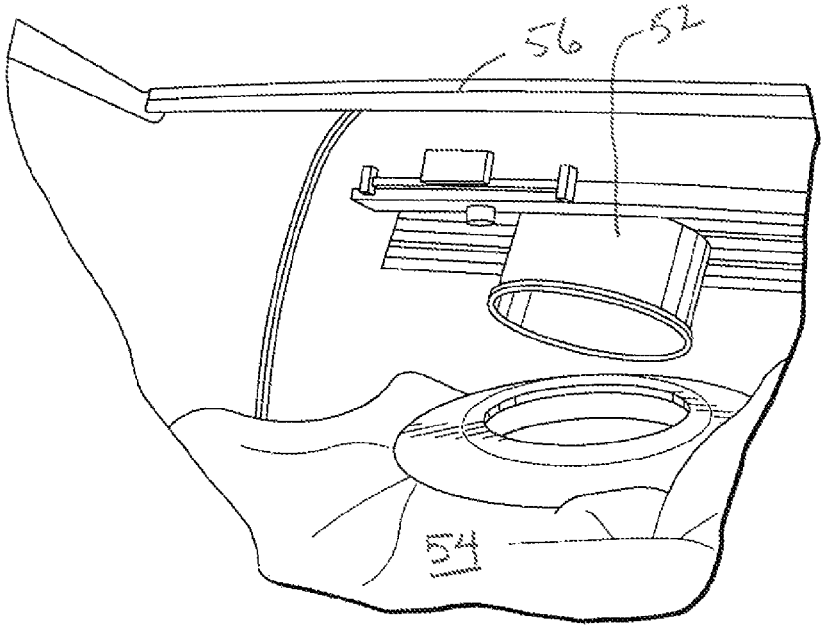
FIG. 6 is

As best shown with respect to FIGS. 1 & 6, the conduit 16 connects with the ACV 50. The ACV 50 includes an external port 52. The external port 52 extends from the outside of the housing of the ACV 50 as shown in FIGS. 1 and 2 through an opening in the housing and into the filter media 54. In an exemplary embodiment, the ACV includes a filter frame 56. The filter frame 56 holds the filter media, typically a filter bag 54. Additionally, the external port 52 is integrated on the frame 56 and as is best shown in FIG. 6, the external port 52 extends through the frame 56 and into ACV housing and at least a portion of the external port 52 adaptable for readily connecting with the filter bag 54.

Clearly, there are a variety of methods and structures for detecting connection of the ACV with the HHU 10. For example, different exemplary embodiments have infrared sensors on the automatic cleaner which detect the connection of the HHU 10 and the ACV. Other examples include the following:

1. A processor sampling current at the connection point and detecting a change in potential; upon the differential being great enough, the programming shifts to the HHU programming;

2. An RF remote controller allows the user to select the programming mode; and

Figure 5:
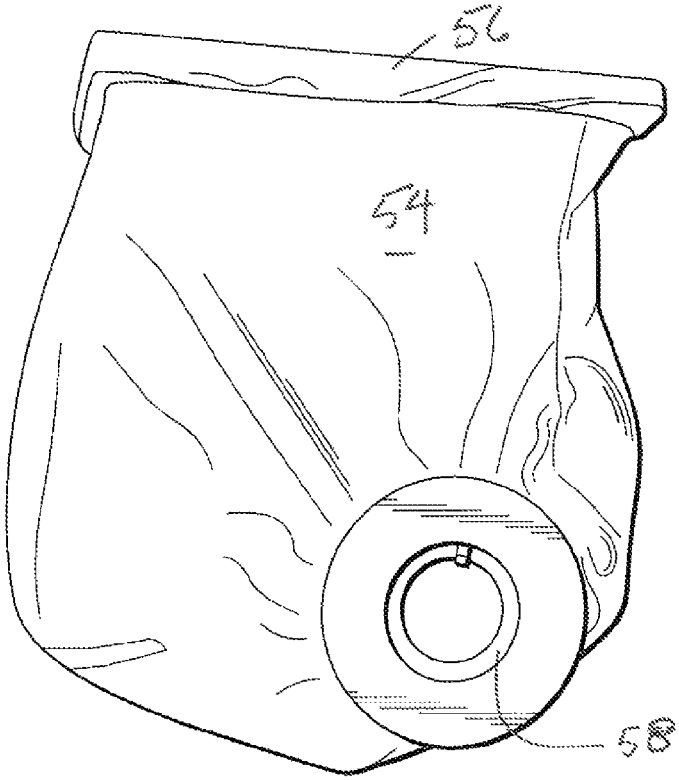
FIG. 5 is a perspective view of the filter media adaptable for connection with the external port.

3. Similarly, an IR remote control allows the user to select the programming mode;

With particular reference to FIG. 5, there is shown the filter bag 54 held securely by the frame 56. Typically the filter bag is made of a plastic woven or mesh material. The material traps the dirt and debris as water travels through the ACV housing. The filter bag 56 has an opening defining an intake 58. The intake 58 is sized and shaped for compatible mating fitting of the intake 58 with the external port 52.

As can be appreciated the filter bag 54 receives dirt and debris from whatever source that comes through the external port. When connected to the conduit 16, the HHU sucks up dirt and debris through the end 20 through the main body 12 into the conduit 16 and then through the external port 52 into the filter bag 54.

Figure 7:
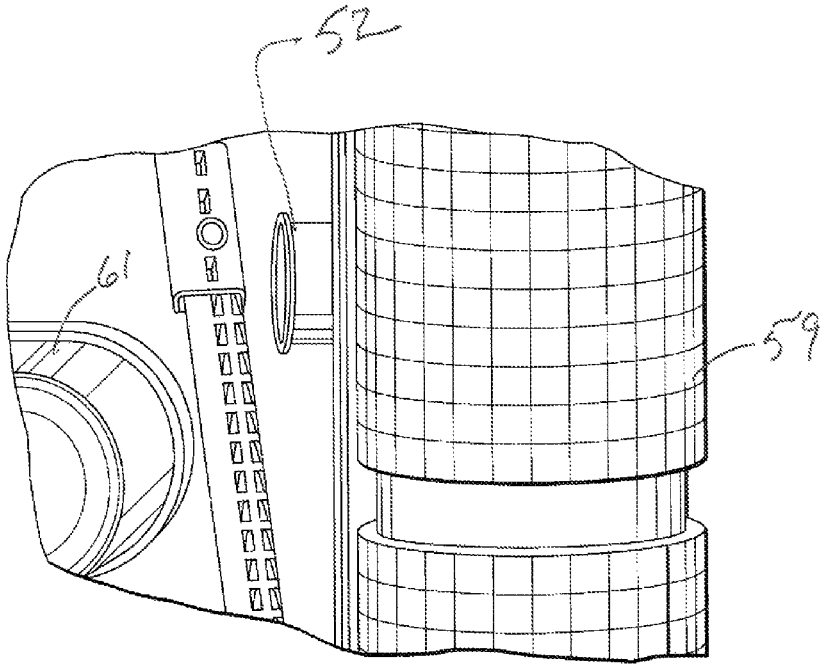
FIG. 7 is a perspective view of the inner end of the external port within the housing of the automated cleaning vehicle adaptable for connection with the filter media.

With particular reference to FIG. 7, there is shown a view of the inner portion of the external port 52 in relation to the ACV roller 59 and the housing interior as well as its relationship to the ACV pump 61. As illustrated, the inner portion of the external port 52 extends well into the interior of the ACV housing, providing ready access for connection with the filter media and in the exemplary embodiment, the filter bag 54.

Figure 8:
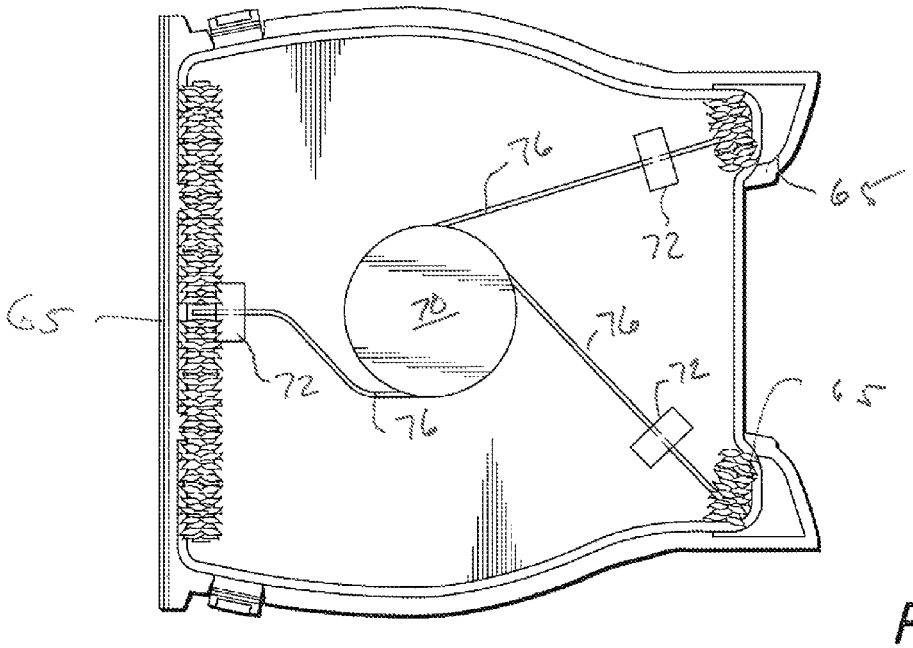
FIG. 8 is a bottom perspective view of the housing illustrating the shut off mechanism for the intake vents in one embodiment in accordance with the invention.

With particular reference to FIG. 8, there is shown an exemplary mechanism for shutting off the ACV intake ports 65. As described above and detailed below, in normal operation, the ACV includes automatic programming to turn on the pump, create a vacuum for sucking pool water through the intake ports 65. When the HHU 10 is attached to the ACV mechanically, electro-mechanically or electronically, the automatic program is disengaged and the manual program then controls the operation of the ACV.

In the manual mode, as is well known in the art, new programming is readily substituted for the default of automated programming. In the exemplary embodiment in accordance with the invention and as will be detailed below with respect to FIG. 9, the connection of the HHU to the ACV causes the automatic or default programming to switch over to manual. The substitute programming, provided by an exemplary embodiment of the invention, causes the ACV to cease locomotion, continues the operation of the pump 61, causing a vacuum to continue to be created, and a re-directing of the vacuum pressure.

In order to redirect the vacuum pressure in an economical and efficient manner, while taking advantage of the already existing pool equipment, the intake vents are closed. This, in one embodiment, is done manually, and in another embodiment the substitute programming causing mechanical movement of a mechanism, which closes the intake vents 65.

In the exemplary embodiment illustrated in FIG. 8, the mechanism for closing the intake vents 65 includes a rotary member 70 and blocking members 72. Each of the blocking members 72 is connected to the rotary member via activation rods 76. Upon rotation of the rotary member 70 clockwise, the rods 76 move the blocking members toward their respective intake vents 65. The rods 76 and the rotary movement are sized and shaped to move compatibly to completely seal off the intake vent 65. Upon disconnection of the HHU 10 from the ACV, the default program resumes and the rotary member 70 rotates in the counter-clockwise direction allowing free flow of pool water through intake vents 65.

When the intake vents 65 are completely sealed, the low pressure center or vacuum in the housing is then directed through the external port 52. Since the HHU 10 is in fluid communication with the ACV through the conduit 16, a vacuum is created at end 20 for sucking up dirt and debris from the water and sending it to the filter bag 54 for cleaning.

Figure 9:
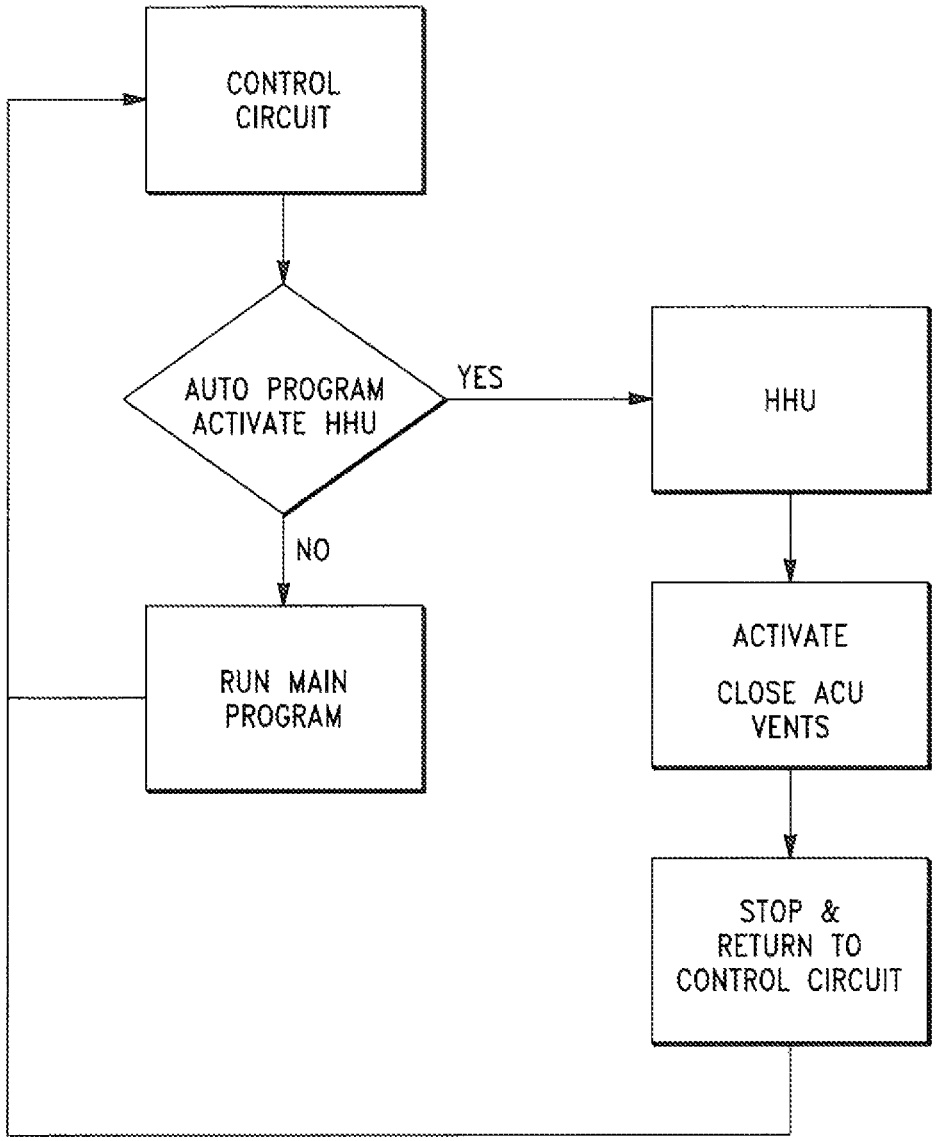
FIG. 9 is a schematic view of the system operation of the hand held cleaning unit in combination with the automated cleaning vehicle.

In other exemplary embodiments, the methods for closing the intake vents 65 are as follows:

1. The mechanism for closing the vents 65 includes a latch pin, which moves open or closed in response to a signal from the control circuit (FIG. 9);

2. The mechanism for closing the vents 65 includes pressure fitting the doors or flaps, which likewise are moved into a closed or open position upon response from a control signal (FIG. 9);

3. The mechanism for closing the vents 65 includes using a hook and loop type fastener which upon sensing a control signal (FIG. 9) close or open the fasteners;

4. The mechanism for closing the vents 65 includes using a hook and loop type fastener which upon sensing a control signal (FIG. 9) closes or opens the fasteners;

5. The mechanism for closing the vents 65 includes a solenoid device which in response to a control signal closes or opens the vent intakes 65; and 6. The mechanism for closing the vents 65 includes a magnetic keyway, which in response to a control signal closes or opens the vent intakes 65;

With particular reference to FIG. 9, there is shown the operation of the HHU 10 in accordance with the invention. As discussed above, initially the operation of the ACV is controlled by the default programming of the ACV. Upon connection of the HHU 10 to the ACV, the HHU is activated. Upon activation, the HHU 10 closes the intake vents 65, shifts the ACV program from automatic to manual. In manual, the ACV default program is substituted for the HHU programming. As described above, the vacuum continues being created and the ACV locomotion ceases, upon engagement of the HHU 10.

Upon completion of use of the HHU 10, the HHU 10 is detached from the ACV and program control is returned to the ACV control circuit. At this point the cycle has been completed and the HHU 10 is ready for its next use.

While the foregoing detailed description has described several embodiments of the hand held cleaning unit in accordance with this invention, it is to be understood that the above description is illustrative only and not limiting of the disclosed invention. Particularly, the hand held cleaning unit in accordance with this invention includes a variety a methods for manually or automatically opening and closing the intake vents. Additionally, the hand held cleaning unit in accordance with this invention includes means for substituting the ACV programming for the HHU programming. It will be appreciated that the embodiments discussed above and the virtually infinite embodiments that are not mentioned could easily be within the scope and spirit of this invention. Thus, the invention is to be limited only by the claims as set forth below.

What is claimed is:

1. A hand held cleaning unit for use with an automated pool cleaning unit, the pool cleaning unit having a housing, a pump mechanism for creating vacuum pressure, intake vents in fluid communication with the pump and default programming for keeping the vents normally open and directing vacuum pressure toward the intake vents, the housing having an external port, the pump selectively in fluid communication with the external port; The hand held cleaning unit comprising: a hand held unit having a main body, the body having a port, and conduit means connecting the main body port with the housing external port, the hand held unit including means closing the intake vents and directing vacuum pressure to the hand held cleaning unit.

2. The hand held cleaning unit for use with an automated pool cleaning unit as set forth in claim 1, wherein the means for activating the hand held unit activates the means for closing the intake vents and directing vacuum pressure to the hand held cleaning unit.

3. The hand held cleaning unit for use with an automated pool cleaning unit as set forth in claim 1, wherein the automated cleaning unit includes means for programming and wherein the programming includes two modes, a default mode wherein the vents are open and vacuum pressure is created to suck up pool water through the intake vents and a manual mode, wherein connection of the hand held cleaning unit to the automated cleaning unit changes the default mode to a manual mode allowing the intake vents to be closed and vacuum pressure directed to the handheld cleaning unit through the conduit means.

4. The hand held cleaning unit for use with an automated pool cleaning unit as set forth in claim 3, wherein upon activation of the hand held cleaning unit, the locomotion of the automated pool cleaning unit ceases and the intake vents close.

5. The hand held cleaning unit for use with an automated pool cleaning unit as set forth in claim 3, wherein automated pool cleaning unit includes a subprogram, which, upon connection of the hand held cleaning unit conduit means with the external port, the automated cleaning unit to cease all locomotion, the pump motor continues creating a vacuum pressure and the intake vents close and vacuum pressure is directed toward the hand held cleaning unit.

6. The hand held cleaning unit for use with an automated pool cleaning unit as set forth in claim 5, wherein the external port includes keyed means for attachment of the hand held cleaning unit and wherein the body port of the hand held cleaning unit includes a mating keyed means for attachment to the automated pool cleaning unit.

7. The hand held cleaning unit for use with an automated pool cleaning unit as set forth in claim 5, wherein the hand held cleaning unit is attached to the automated pool cleaning unit using compatible magnetic connectors.

8. The hand held cleaning unit for use with an automated pool cleaning unit as set forth in claim 5, wherein the hand held cleaning unit is attached to the automated pool cleaning unit using a pressure fit connector.

9. The hand held cleaning unit for use with an automated pool cleaning unit as set forth in claim 5, wherein the hand held cleaning unit is attached to the automated pool cleaning unit using compatible threaded connectors.

10. The hand held cleaning unit for use with an automated pool cleaning unit as set forth in claim 5, wherein the hand held cleaning unit is attached to the automated pool cleaning unit using a cinch means.

11. The hand held cleaning unit for use with an automated pool cleaning unit as set forth in claim 5, wherein the hand held cleaning unit is attached to the automated pool cleaning unit using an external clamp.

12. The hand held cleaning unit for use with an automated pool cleaning unit as set forth in claim 5, wherein the automated cleaning unit includes infrared sensors for detecting connection of the hand held cleaning unit with automated cleaning unit.

13. The hand held cleaning unit for use with an automated pool cleaning unit as set forth in claim 5, wherein the automated cleaning unit includes a processor for sampling electrical deviations for detecting connection of the hand held cleaning unit with automated cleaning unit.

14. The hand held cleaning unit for use with an automated pool cleaning unit as set forth in claim 5, wherein the subprogram is activated by an RF controller.

15. The hand held cleaning unit for use with an automated pool cleaning unit as set forth in claim 1, wherein intake vents are closed manually upon connection of the automated cleaning unit with the hand held cleaning unit.

16. The hand held cleaning unit for use with an automated pool cleaning unit as set forth in claim 1, wherein intake vents are closed electro-mechanically upon connection of the automated cleaning unit with the hand held cleaning unit.

17. The hand held cleaning unit for use with an automated pool cleaning unit as set forth in claim 1, wherein the main body includes distal and proximal ends and the distal end is adapted to receive special aid cleaning end means for cleaning irregular surfaces and forms.

18. The hand held cleaning unit for use with an automated pool cleaning unit as set forth in claim 1, wherein a handle is attached to the hand held cleaning unit.

19. A hand held cleaning unit for use with an automated pool cleaning unit, the pool cleaning unit having a housing, a pump mechanism for creating vacuum pressure within the housing, intake vents in fluid communication with the vacuum created by the pump mechanism and the intake vents normally urged to the open position, the hand held cleaning unit comprising:

a hand held cleaning unit including conduit means in fluid communication with the pump mechanism for creating a vacuum within hand held unit, the fluid communication created through conduit means;

means for closing the intake vents and redirecting the vacuum created by the pump mechanism to the hand held unit; and means for de-activating the hand held means by returning the intake vents and vacuum to their normal positions.

20. A hand held cleaning unit for use with an automated pool cleaning unit, the pool cleaning unit having a housing, a pump mechanism for creating vacuum pressure within the housing, and a variety of suction points for sucking up dirt and debris, which are in fluid communication with the vacuum created by the pump and suction points being normally urged to an open position for picking up dirt and debris, the hand held cleaning unit comprising:

a hand held unit including conduit means in fluid communication with the vacuum created by the pump mechanism, vacuum pressure creating a vacuum within hand held unit through conduit means;

means for closing the suction points and redirecting the vacuum created by the pump mechanism to the hand held unit; and means for de-activating the hand held means by returning the suction points and vacuum pressure to their normal positions.

* * * * *